United States Patent [19]

Miwa

[11] Patent Number: 4,779,809

[45] Date of Patent: Oct. 25, 1988

[54] HORIZONTAL ROTATING TYPE GRINDING MACHINE

[75] Inventor: Shigeo Miwa, Kyoto, Japan

[73] Assignee: Tokuju Kosakusho Company, Ltd., Tokyo, Japan

[21] Appl. No.: 872,789

[22] Filed: Jun. 10, 1986

[30] Foreign Application Priority Data

Sep. 2, 1985 [JP] Japan ..... 60-191871

[51] Int. Cl.[4] ..... B02C 17/14

[52] U.S. Cl. ..... 241/69; 241/175; 241/179

[58] Field of Search ..... 241/153, 184, 175, 171, 241/69–72, 179, 101.2; 51/163.2, 163.1

[56] References Cited

U.S. PATENT DOCUMENTS

| | | | |
|---|---|---|---|
| 2,982,485 | 5/1961 | Fahrenwald | 241/175 |
| 3,030,036 | 4/1962 | Chapman | 241/175 |
| 3,042,322 | 7/1962 | Symons | 241/175 |
| 3,233,835 | 2/1966 | Sevin et al. | 241/72 |
| 3,286,939 | 11/1966 | Karpenko et al. | 241/175 |
| 4,098,465 | 7/1978 | Meller et al. | 241/153 X |
| 4,125,335 | 11/1978 | Blume et al. | 241/175 X |

*Primary Examiner*—Mark Rosenbaum

*Attorney, Agent, or Firm*—Schwartz & Weinrieb

[57] ABSTRACT

A horizontal rotating type grinding machine comprises a grinding vessel into which material to be ground is charged, a grinding medium disposed upon the inner peripheral wall surface of the grinding vessel and rotatable in the grinding vessel, and a turning motion mechanism for oscillating the grinding vessel along a horizontal circular track, whereby the material to be ground which is charged into the grinding vessel is finely ground between the inner peripheral surface of the grinding vessel and the grinding medium.

20 Claims, 5 Drawing Sheets

HORIZONTAL ROTATING TYPE GRINDING MACHINE

FIELD OF THE INVENTION

This invention relates to a grinding technique for grinding material to be ground such as stone, silica, foodstuff, and the like, and more particularly to a device for performing fine grinding.

BACKGROUND OF THE INVENTION

Heretofore, various devices have been used for grinding material to be ground such as stone, silica, foodstuff and the like. For example, impact mills, roll mills, tumbling ball mills, vibrating ball mills, and the like, are representative devices, and particularly, as a device for fine grinding, the tumbling ball mill or vibrating ball mill have been used in many cases.

The conventional tumbling ball mill is constructed in such a way that material to be ground is charged into a grinding vessel loaded with a grinding medium, and the grinding vessel is rotated so as to grind the material to be ground by the grinding medium by means of gravity. Similarly, the conventional vibrating ball mill has such a construction as to improve the grinding effect of the tumbling ball mill by giving a high intensity vibration to the grinding medium.

However, since the conventional tumbling ball mill was dependent only upon gravity with respect to its grinding operation, in order to make the grain size of the material to be ground smaller, it was necessary to make the diameter of the grinding vessel to be extremely large and to expend an extremely long grinding time.

In addition, while the vibrating ball mill eliminated the problem of the increased diameter of the grinding vessel and its mounting base as well as the long grinding time of the grinding medium by means of the high intensity vibrating effect, the power required was quite great in view of the mill construction, and the consumption of power became excessive, both characteristics of which proved to be operational problems.

OBJCTS OF THE INVENTION

An object of this invention, accordingly, it to provide a grinding machine which has eliminated the problems of the foregoing devices, which has a faster grinding speed, and which is of relatively simple construction, light in weight, and capable of performing fine grinding with a low consumption of power.

SUMMARY OF THE INVENTION

This invention has been made to achieve the foregoing objects, and is constructed in such a way that the grinding vessel is made to move in a swirling mode which moves the grinding medium so as to thereby impart a high intensity centrifugal effect to the grinding medium and at the same time, a far smaller centrifugal effect is applied to the grinding vessel and its mounting base than to the grinding medium, and thus, the device is of relatively small size and of simple construction and can be operated with a minimum consumption of power.

These objectives will be achieved as follows by this invention.

Namely, this invention comprises a grinding vessel into which material to be ground is charged, a grinding medium disposed upon the inner peripheral surface of the wall of the grinding vessel and rotatable in the grinding vessel, and a rotating-oscillating motion mechanism for gyrating the grinding vessel along a circular track, whereby the material to be ground which is charged into the grinding vessel is finely ground between the inner peripheral surface of the grinding vessel and the grinding medium with a high intensity rubbing action.

The grinding principle and grinding operation of this grinding machine are effected as follows, and the grinding machine will be described in accordance with FIG. 1 and FIG. 2.

FIG. 1 is a schematic plan view of the grinding vessel showing a circular motion of the vessel, and the two point-chained line shows a condition wherein the grinding vessel is moved from a position of the solid line through a clockwise circular motion of 90 degrees. In this drawing, reference numeral 1 denotes a grinding vessel, 2 denotes a grinding medium, 3 denotes a revolving track of the center of the grinding vessel, the radius of the grinding vessel 1 is denoted as R, the diameter of the grinding medium 2 is denoted as a, and the rotary radius of the revolving track 3 is denoted as r.

The grinding medium 2 is charged into the grinding vessel 1 and then, the grinding vessel 1 is revolved in the horizontal plane (hereinafter referred to as "gyro motion"). When the grinding vessel 1 is undergoing its gyro motion with the rotary radius r, the grinding medium 2 effects a swirling motion along the surface of the wall of the vessel with the radius R in the interrelationship $(R-a/2)$ between the radius R of the grinding vessel 1 and the diameter a of the spherical grinding medium 2. At this time, in case the grinding medium 2 is one piece, it rotates at a speed equal to that of the gyro motion, and it also moves while it is being urged against the inner wall of the grinding vessel by means of the centrifugal force generated by means of the rotary motion of the grinding vessel. The destruction and friction forces are applied to the material to be ground by means of the rotary and centrifugal forces of the grinding medium 2, and as a result, the grinding operation is completed. In the case of using many grinding mediums, a rubbing action action of each of the grinding mediums has an additional grinding effect. The centrifugal effect Ks generated by means of the gyro motion is represented by means of the following formula:

$$Ks = r \times w^2/g$$

wherein:

r = rotary radius of gyro motion w = rotary angular speed g = gravity acceleration Also, the centrifugal effect Km of the spherical grinding medium 2 is represented by the following formula:

$$Km = (R-a/2)w^2\,g$$

wherein:

R = radius of grinding vessel a = diameter of grinding medium

In order to establish $R > r$, it is possible to sufficiently enlarge the centrifugal effect of the grinding medium in comparison with the centrifugal effect of the gyro motion of the vessel. The enlargement of the centrifugal effect results in the improved grinding effect, namely, the provision of a high intensity rubbing action.

For example, the foregoing centrifugal effect becomes Ks=1.7 in the case where r=25 mm, w=26.2 (rad/s), (250 rpm) are set, and Km=10 is established with R=150 mm at the time. Km=10 shows an upper limit value of the centrifugal effect that can be achieved by the conventional vibrating mill. This invention can easily attain a centrifugal effect of Km>10 at the grinding surface, with a simple driving mechanism.

Moreover, FIG. 2 shows the case where the grinding vessel 1 has an inner wall surface which is inclined by means of an angle $\theta$ with respect to a turning axis T1 which is disposed perpendicular to the revolving surface S, and the centrifugal effect Km produces components of force on its surface as follows:

Km cos $\theta$ in the perpendicular direction with respect to the inner wall surface Km sin $\theta$ in the direction of the axis of revolution T2

The operation of the components of force in the direction of the axis of revolution T2 results in the material to be ground, tending to be accumulated upon the bottom portion of the grinding vessel, to constantly shift to a position upon the inner wall surface of the grinding vessel 1 so that the grinding effect can be improved by means of properly designing the angle of inclination and direction of the inner wall surface.

At this stage, when the number of grinding mediums is remarkably increased, and while a tendency of blocking the free motion of the grinding mediums along the inner wall is produced, the grinding effect is nevertheless increased by the collision and friction of the mediums.

Furthermore, in the case of a mixture of grinding mediums whose diameters are more than two different values, segregation of the grinding mediums occurs inside of the grinding vessel with the grinding medium having the larger diameters being collected upon the relatively upper layer while the grinding mediums having the smaller diameters being collected upon the lower layer. This means that the coarse material to be ground is ground by means of the large grinding medium and the fine material to be ground is ground by means of the small grinding medium so that the preferable operation of improving the grinding effect is carried out.

Accordingly, the horizontal rotating type grinding machine of the present invention grinds material to be ground by disposing grinding mediums upon its inside surface, and the grinding vessel is capable of housing the material to be ground and the grinding mediums interiorly within the vessel, and in addition, any construction may be employed so long as the grinding medium is disposed upon the rotatable inner peripheral surface of the grinding vessel. Namely, needless to say, it is possible to make various modifications and variations on the basis of the foregoing principles, and a concrete embodiment of the present invention will now be described as follows by referring to the drawings.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein.

DETAILED DESCRIPTION OF THE ILLUSTRATED EMBODIMENTS

Figure 1:
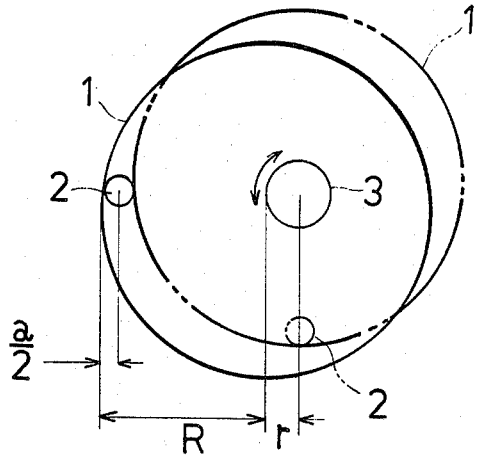
FIG. 1 is a schematic plan view showing a circular motion pattern of a grinding vessel.
Figure 2:
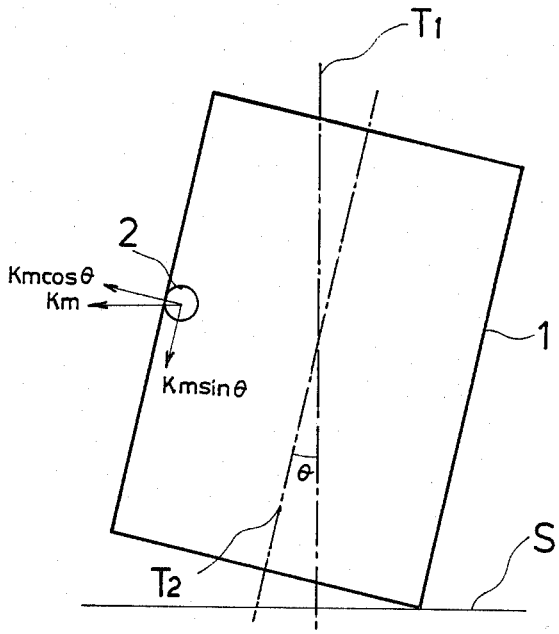
FIG. 2 is a vertical cross section showing the grinding vessel that is inclined.
Figure 3:
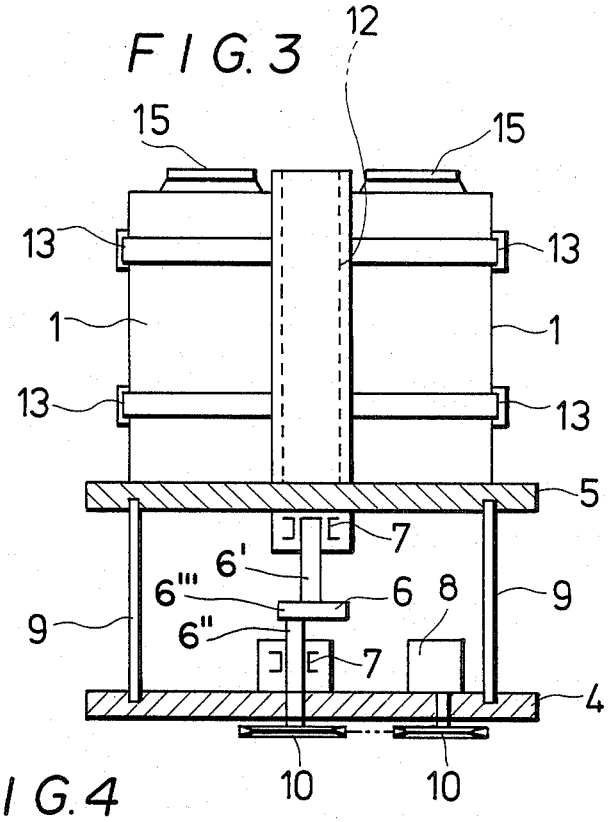
FIG. 3 shows a horizontal rotating type grinding machine representing a first embodiment of the present invention.
Figure 4:
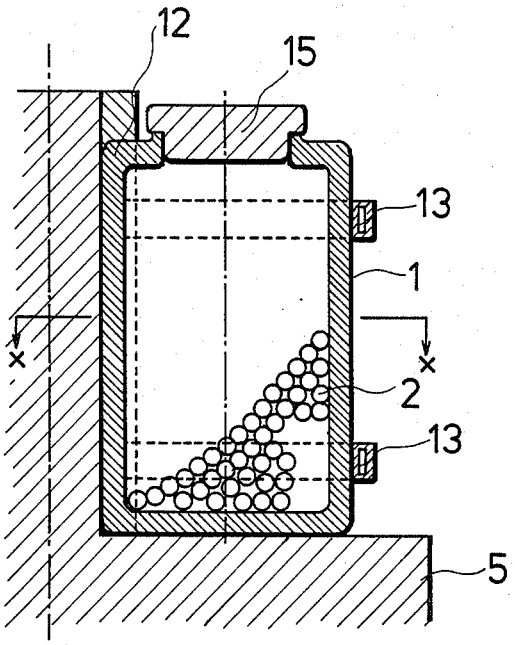
FIG. 4 is a vertical cross-section of one of the grinding vessels as mounted upon the machine of FIG. 3.
Figure 5:
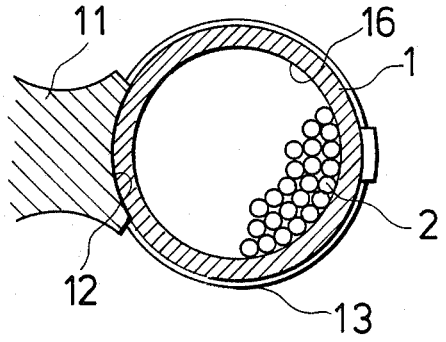
FIG. 5 is a cross-section taken along line x—x in FIG. 4.

FIG. 3 through FIG. 5 show a first embodiment of the horizontal rotating type grinding machine in which a plurality of cylindrical grinding vessels 1 with bottoms are mounted upon an identical surface.

Symbol 4 denotes a mounting base for a shaft for generating a gyro motion, and the shaft 6 is mounted upon the base 4 by means of a bearing 7. Rotary motion is transmitted to the shaft by means of a pair of pulleys 10 provided upon the shaft 6 and the bottom portion of a motor 8. The upper portion 6′ of the shaft 6 is axially mounted upon a turning base 5 by means of another bearing 7, the upper portion 6′ of the shaft 6 and the lower portion 6″ of the shaft 6 are eccentric with respect to each other, and therefore, when the lower portion of the shaft is rotated, the upper portion is arranged so as to rotate through a circular locus with a radius r. A plurality of support rods 9 made of an elastic material are interposed between the base 4 and the turning base 5 so as to prevent the rotation of the turning base 5 and to support the turning base 5 so as to be horizontally movable through a nutation movement. Symbol 11 denotes a support column erected in the center of the turning base 5. An outer wall surface of the cylindrical grinding vessel 1 is disposed in contact with a concave arcuately shaped portion 12 formed upon a peripheral section of the support column 11, and vessel 1 is detachably connected thereto by a clamping means 13 such as a clamp or the like.

Symbol 15 denotes a cover member which is capable of opening or closing a charge inlet of the grinding vessel 1.

The horizontal rotating type grinding machine of the foregoing construction is constructed in such a way that after the material to be ground is charged by 50–80% into the cavity of the grinding vessel 1 which is fixedly secured to the support column 11 by means of the clamping means 13, the covering member 15 is used to cover the inlet of vessel 1, and the grinding is carried out by driving motor 8. When the shaft 6 is rotated in the range of 100–500 rpm and the turning radius is 5–50 mm, the motion mentioned above is applied to the grinding medium 2, and thus, the material to be ground is finely ground. Furthermore, when fluid is added to the horizontal rotating type grinding machine of this embodiment, the grinding can be carried out in a wet system.

Figure 6:
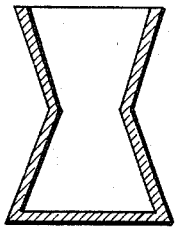
FIG. 6 through FIG. 9 show other embodiments of a grinding vessel having different vertical cross-sectional shapes, the embodiment shown in FIG. 6 being of a drum type, the embodiment shown in FIG. 7 being of a circular truncated conical shape, the embodiment shown in FIG. 8 being of an inverted circular truncated conical shape, and the embodiment shown in FIG. 9 being of a barrel type.
Figure 7:
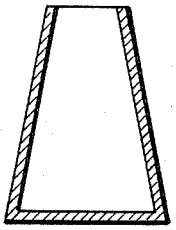
Figure 8:
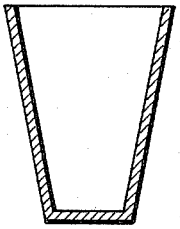
Figure 9:
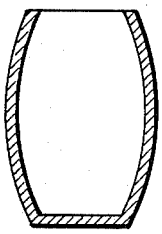

Next, FIG. 6 through FIG. 9 show other embodiments of the grinding vessel 1 having different vertical cross-sectional shapes, wherein the embodiment represented in FIG. 6 is of the drum type, the embodiment represented in FIG. 7 is of a circular truncated conical shape, the embodiment represented in FIG. 8 is of an inverted circular truncated conical shape, and the embodiment represented in FIG. 9 is of the barrel type. In any of these grinding vessels 1, the centrifugal effect Km produces components of force of Km cos $\theta$ in the perpendicular direction with respect to the inner wall surface and Km sin $\theta$ in the direction of the axis of revolution T2 along its surface as a result of the inner wall surface being inclined at an angle $\theta$ along with the axis of revolution T2. The material to be ground which tends to be accumulated upon the bottom portion of the grinding vessel 1 is constantly shifted to a position along a predetermined portion of the inner wall surface of the grinding vessel 1 which is an operation produced by means of the operation of the components of force in the aforenoted directions relative to the axis of revolution T2.

Figure 10:
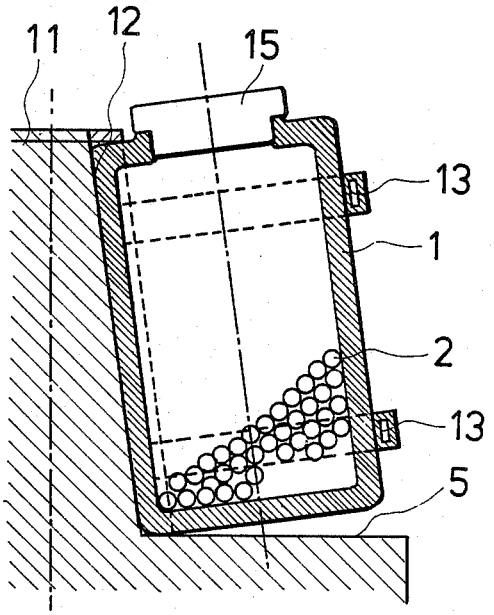
FIG. 10 is a cross-section of an essential portion of a grinding machine representing another embodiment in which the axis of revolution of the grinding vessel is inclined with respect to the axis of revolution of the circular motion mechanism.

Next, FIG. 10 shows another embodiment in which the axis of revolution of the cylindrical grinding vessel 1 is properly inclined with respect to the turning axis T1 of the turning circular motion mechanism.

Symbol 11 denotes a support column of a conical shape erected in the center of the turning base 5, and a concave portion 12, of an arcuate shape formed at the peripheral side of the support column 11, is formed with an angle of inclination of $\theta$ with respect to the axis of the support column 11. Surface 12 is in contact with the outer wall surface of the cylindrical grinding vessel 1, and vessel 1 is detachably connected to column 11 by means of the clamping means 13 such as a clamp or the like. Accordingly, when the grinding vessel 1 is mounted upon the turning base 5 by the clamping means 13, the axis of revolution of vessel 1 is inclined, and thus, the axis of revolution with the inclined angle $\theta$ is provided.

Accordingly, in the foregoing construction, the grinding vessel 1 has an inner wall surface 16 (see FIG. 5) inclined by means of an angle $\theta$ and with the turning axis T1 perpendicular to the revolving surface S. In addition, the direction becomes opposite on the opposed surfaces so that the centrifugal effect Km produces components of force, Km cos $\theta$ whose directions are constantly changed in the perpendicular direction with respect to the inner wall surface, and Km sin $\theta$ in the direction of the axis of revolution T2 along its surface. Namely, in this embodiment, when the grinding vessel, whose axis of revolution is inclined, is moved so as to turn in a circular manner, the material to be ground is made to rotatably flow in a "FIG. 8" upon the inner peripheral surface of the wall of the grinding vessel 1, and since the components of force by the centrifugal effect, whose direction constantly fluctuates, are generated in the axial direction, the material to be ground can be positively and uniformly ground within a short period of time.

Figure 11:
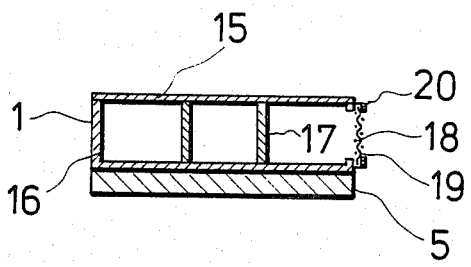
FIG. 11 is a vertical cross-section representing another embodiment of the grinding vessel provided with an inner cylinder.
Figure 12:
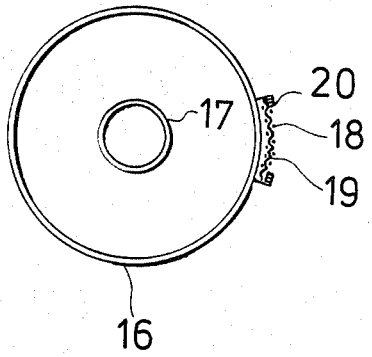
FIG. 12 is a plan view of the foregoing embodiment.

FIG. 11 and FIG. 12 show another embodiment of the grinding vessel 1, and an inner cylinder 17, having a diameter of almost 0.25–0.50 as that of the wall 16, is mounted concentrically within the wall 16 such that its height is equal to or slightly less than the height of the wall 16, and thus, an annular cavity is formed within the vessel. In this construction, the inner cylinder 17 controls the range of motion of the grinding medium 2, and performs the operation of limiting the range of dispersion of the msterial to be ground. In addition, a screen 18 spans an opening formed within one peripheral sidewall portion of the wall 16. Normally, a plug plate 19 covers the opening, plate 19 being fixed by means of a clamping means 20 such as a bolt or the like so that the mesh of the screen determines the size of the grinding medium 2, and is of the size that will not permit the passing therethrough of the grinding medium 2.

In the grinding vessel 1 of this embodiment, upon completion of the grinding operation, the plug plate 19 is removed so as to effect the gyro motion and thereby permit sifting out of the material by the screen 18, and the ground fine powder is discharged out of the grinding machine by means of the screen 18. The grinding medium 2 and the material to be ground that is of the coarse type and not having reached the predetermined grain size remain in the grinding vessel 1.

Figure 13:
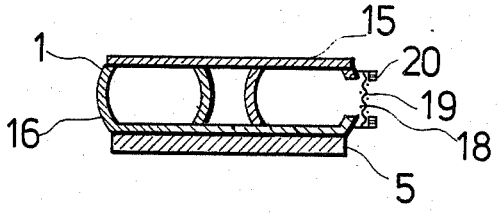
FIG. 13 is a vertical cross-section representing another embodiment of the grinding vessel.

Furthermore, the embodiment represented in FIG. 13 is of a construction in which the wall surfaces of the wall 16 and the inner cylinder 17 are curved or arcuately formed along their vertical extent, and the curvature of such curved portions is determined by the diameter of the grinding medium. In addition, the screen 18 spans the notch formed within the peripheral wall portion of the wall 16. Normally, the plug plate 19 covers the opening or notch, plate 19 being fixedly secured by means of a clamping means 20, such as a bolt, or the like, so that the mesh of the screen 18 determines the size of the grinding medium 2, and is of such a size that does not pass the grinding medium 2 therethrough.

This grinding vessel 1 is constructed in such a way that the wall 16 and the inner cylinder 17 are curved so that the grinding operation is accelerated by applying rolling motion in the upward direction to the material to be ground and to the grinding medium 2. Accordingly, when the grinding medium 2 of 50–80% by volume of the cavity and the material to be ground are charged into the grinding vessel 1, the cover member 15 is mounted upon the surface of the opening, and the turning base 5 is oscillated, the grinding medium 2 undergoing the rolling motion along the wall 16 of the grinding vessel 1 while also undergoing mutual collision. The material to be ground is subjected to shearing and pulverization by means of the rotary and turning motions occurring at the same time and is impact ground as a result of the mutual collisions. The revolution speed of the grinding medium at the time is changed by means of the turning radius of the gyro motion and the number of revolutions so that the revolutions of the grinding machine can be made to approach the number of revolutions of the gyro motion under the increased centrifugal effects.

Figure 14:
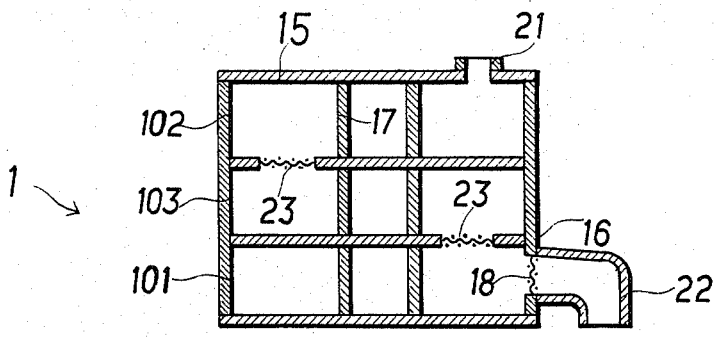
FIG. 14 is a cross-section representing another embodiment of the grinding vessel which has a plurality of layers defined therein.
Figure 15:
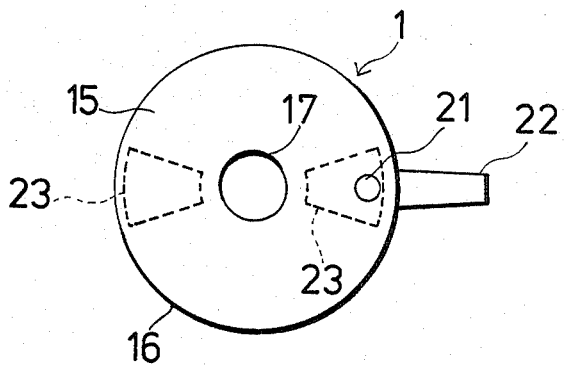
FIG. 15 is a plan view of the foregoing embodiment.

FIG. 14 and FIG. 15 show an embodiment of the grinding vessel 1 that is laminated in a plurality of layers, this example showing three layers 101, 102, 103, and the cover member 15, formed with charge inlet 21, is mounted upon the upper stage of the grinding vessel 1. The screen 18 spans the notch formed upon the lowest stage part 101 of the wall 16 of the grinding vessel 1, and a discharge chute 22 is provided so as to project exteriorly thereof. The inner cylinder 17 of a diameter of almost 0.25–0.50 of the wall 16 is formed so as to be equal to or slightly less than the height of the wall 16 throughout the entire height of vessel 1 and is disposed concentrically at the axial center of the grinding vessels 101, 102, and 103. In addition, screens 23, 23 are disposed within each bottom surface of the grinding vessels 102, 103 excluding the grinding vessel 101 of the lowest stage, and the adjacent grinding vessels of the upper and lower stages are communicated with each other by means of the screens 23. The upper screen 23 of the grinding vessel 102 of the highest stage is provided at a symmetric position of 180 degrees diametrically opposite the charge inlet 21, and the screen 23 of the adjacent grinding vessel 103 of the middle stage is displaced by 180 degrees with respect to the screen 23 of the upper stage.

The grinding medium 2 and the material to be ground are filled to 50–80% by volume in the space between the wall 16 of the grinding vessel 102 and the inner cylinder 17, and the grinding vessel 1 is rotated so that the charged material to be ground, charged through the charge inlet 21, swirls in the grinding vessel 102 of the highest atage while being ground by means of the turning, rotation, and collision movements of the grinding medium 2. The material to be ground having a large grain size among the material tends to become the upper layer and the material of smaller size tends to become the lower layer, and the material to be ground having a grain size smaller than a predetermined grain size passes through the upper screen 23 and drops into the grinding vessel 103 of the middle layer. The material to be ground which drops to the brinding vessel 103 of the middle layer is ground by means of the grinding vessel 103, and then, drops to the grinding vessel 101 of the lowest stage through means of the lower screen 23. The material to be ground which is ground by means of the grinding vessel 101 of the lowest stage if subjected to forces so as to be sifted out through the screen 18, and the fine powder ground to a predetermined grain size is discharged out of the grinding machine through means of the discharge chute 22 after passing through the screen 18.

In this construction, since the grain sizes of the material to be ground in each grinding vessel 101, 102, 103 are different, the dimeter of the grinding medium 2 suitable for the desired grain size can be suitably selected, and has advantageous points of improving the grinding efficiency.

Figure 16:
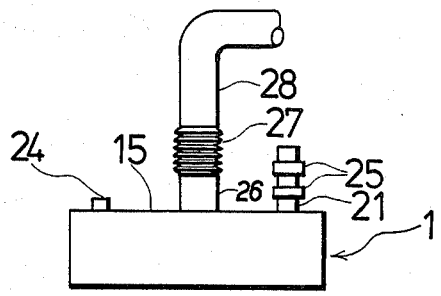
FIG. 16 is an elevation view representing an embodiment in which a classifying pipe is connected to the grinding vessel.

FIG. 16 shows an embodiment in which a fluid classifying pipe is connected to the grinding vessel, and thus, a continuous grinding system becomes possible. It is easy, in this invention, to connect the fluid classifying pipe to the grinding vessel since the grinding vessel is not rotated but is gyrated. A liquid injection nozzle 24 is provided within the vicinity of the outer periphery of the cover member 15 provided upon the upper portion of the grinding vessel 1, and a charge opening 21, for material to be ground which is provided with a valve 25 for loading the material to be ground while blocking the flow of the fluid, is provided upon its opposite side, a fine powder discharge nozzle 26 being provided so as to project upwardly from the center portion of the cover member 15. The fine powder discharge nozzle 26 is connected to the classifying pipe 28 by means of a flexible connector 27. The fluid is filled in the grinding vessel 1, fine powder discharge nozzle 26 and flexible connector 27 are interconnected, and a proper amount of the grinding medium 2 is charged into the grinding vessel 1.

When the grinding vessel 1 is oscillated, the grinding medium 2 undergoes the tunring and rotary motions along the wall 16 and facilitates the continuous supply of the material to be ground into the grinding vessel 1 through means of the charge inlet 21 by means of the valve 25. In this condition, when the fluid is injected through the fluid injection nozzle 24, since the grinding vessel 1 is in a sealed condition, the inside fluid corresponding to the injection amount of the fluid is discharged through the classifying pipe 28 by means of the fine poweder discharge nozzle 26, and flexible connector 27, and at this time, the fine powder is discharged together with the fluid.

As described in the foregoing, the grinding machine of the present invention is capable of continuously grinding the material to be ground by means of a batch system upon connection to the classifying pipe, and is capable of preventing an excessive amount of grinding of the material so that the grinding operation is performed with a high degree of efficiency and at the same time, the degree of classifying flow can be freely adjusted by changing the speed of injection of the fluid from the fluid injection nozzle 24 and by changing the speed of the rising fluid in the classifying pipe 28.

It is to be additionally noted in the foregoing embodiment that the charge inlet 21 for the material to be ground is provided accordingly, however, the material to be ground, which can be transformed into a slurry, can be supplied together with the fluid from the fluid injection nozzle 24.

In the specification, the concrete embodiments or modifications set forth in the DETAILED DESCRIPTION OF THE ILLUSTRATED EMBODIMENTS are provided merely for disclosing the technical contents of the present invention, and although this invention has been described in detail to a certain degree, it is obvious that various changes can be made without running counter to the spirit and scope of this invention to be claimed hereinafter with respect to its embodiments.

What is claimed is:

1. A horizontal rotating type grinding machine, comprising:

a grinding vessel into which material to be ground can be charged;

a grinding medium disposed within said grinding vessel for cooperating with said grinding vessel so as to grind said material to be ground during a grinding operation;

first platform means for fixedly supporting said grinding vessel thereon;

second platform spaced below said first platform means;

rotary eccentric drive means comprising a first drive shaft projecting upwardly from said second platform means, a second driven shaft disposed parallel to and eccentrically related to said first drive shaft so as to be operatively connected to said first platform means for tending to rotate said first platform means and said grinding vessel in response to the rotary drive of said first drive shaft, and a disk portion integrally connecting said first drive and second driven shafts together; and means interconnecting said first and second platform means for preventing rotation of said first platform means and said grinding vessel relative to said second platform means yet permitting said first platform means and said grinding vessel to oscillate relative to said second platform means, in response to the rotary movement of said rotary eccentric drive means, whereby said grinding operation is achieved.

2. A horizontal rotating type grinding machine according to claim 1 wherein:

the longitudinal axis of said grinding vessel is inclined with respect to the rotary axis of said rotary eccentric drive means.

3. A horizontal rotating type grinding machine according to claim 1 wherein:

the cross sectional shape of said grinding vessel is that of a circular truncated cone.

4. A horizontal rotating type grinding machine according to claim 1 wherein:

the cross sectional shape of said grinding vessel is that of a convex barrel.

5. A horizontal rotating type grinding machine according to claim 1 wherein:

said grinding vessel is constructed of a plurality of laminated layers.

6. A horizontal rotating type grinding machine according to claim 1 wherein:

said grinding vessel includes an outer peripheral wall and said grinding vessel further includes an annular cavity defined between said outer peripheral wall and an inner cylindrical concentric with said outer peripheral wall.

7. A horizontal rotating type grinding machine according to claim 6 wherein:

said outer peripheral wall of said grinding vessel, and said inner cylinder, are curved along their axial extents, and said grinding medium is a spherical or columnar material having a degree of curvature which is smaller than the curvature of said inner cylinder or said outer peripheral wall of said grinding vessel.

8. A horizontal rotating type grinding machine according to claim 1 wherein a plurality of grinding mediums are charged into the grinding vessel.

9. A horizontal rotating type grinding machine according to claim 8 wherein the diameters of said plurality of grinding mediums to be charged into the grinding vessel are not uniform.

10. A horizontal rotating type grinding machine according to claim 1 wherein:

a fluid is disposed within said grinding vessel whereby said grinding operation is carried out under wet system conditions.

11. A horizontal rotating type grinding machine according to claim 1 wherein:

a notch opening is defined within an outer peripheral wall portion of said grinding vessel; and a screen is disposed within said notch opening so as to cover said notch opening whereby the material to be ground, upon attaining a predetermined grain size is discharged out of said grinding vessel through said screen.

12. A horizontal rotating type grinding machine according to claim 1 wherein:

said grinding vessel is constructed of a plurality of laminated layers, upper and lower layer is of said grinding vessel are in communication with each other by means of a first screen spanning a first notch opening defined within a partition separating said upper and lower layers of said grinding vessel, and a second screen spans a second notch opening formed within an outer peripheral wall portion of said lower layer of said grinding vessel whereby the material to be ground, upon attaining a predetermined grain size is discharged out of said grinding vessel through said second screen.

13. A horizontal rotating type grinding machine according to claim 1 wherein:

in the case that said grinding vessel is constructed of a plurality of laminated layers, grinding madiums whose diameters different from each other are disposed within respective layers of said grinding vessel.

14. A horizontal rotating type grinding machine according to claim 1, wherein:

said grinding vessel is of a fluidically sealed construction having a part of said grinding vessel connected to a ground material classifying pipe which extends perpendicularly upwardly from said grinding vessel, and a fluid injection nozzle for supplying fluid to said grinding vessel is fluidically connected to said grinding vessel.

15. A horizontal rotating type grinding machine according to claim 14 wherein:

said fluid injection nozzle further includes means for charging slurried material to be ground into said grinding vessel.

16. A horizontal rotating type grinding machine according to claim 1, wherein:

the cross-sectional configuration of said grinding vessel is that of an inverted circular truncated cone.

17. A horizontal rotating type grinding machine as set forth in claim 1, wherein:

the cross-sectional configuration of said grinding vessel is that of a concave drum.

18. A horizontal rotating type grinding machine as set forth in claim 1, wherein:

said interconnecting means comprises flexible connectors between said first and second platform means.

19. A horizontal rotating type grinding machine as set forth in claim 18, wherein:

said flexible interconnecting means comprises a plurality of elastic rods.

20. A horizontal rotating type grinding machine as set forth in claim 1, further comprising:

bearing means respectively provided upon the upper and lower surfaces of said second and first platform means for rotatably supporting said first drive and second driven shafts.

* * * * *